United States Patent [19]
Nishihara et al.
[11] 4,317,675
[45] Mar. 2, 1982

[54] MAGNETIC IRON POWDER CONTAINING MOLYBDENUM

[75] Inventors: Toshikazu Nishihara; Hiromasa Isono; Tunehide Naruse; Sadao Ozaki; Noboru Takahashi, all of Yokohama, Japan

[73] Assignee: Victor Company of Japan, Limited, Yokohama, Japan

[21] Appl. No.: 100,991

[22] Filed: Dec. 4, 1979

Related U.S. Application Data

[62] Division of Ser. No. 948,566, Oct. 4, 1978, abandoned.

[30] Foreign Application Priority Data

Oct. 6, 1977 [JP] Japan ..... 52/120422

[51] Int. Cl.³ ..... C22C 1/04
[52] U.S. Cl. ..... 75/0.5 BA; 75/251
[58] Field of Search ..... 75/0.5 AA, 0.5 BA, 251, 75/252, 0.5 B; 252/62.55

[56] References Cited

U.S. PATENT DOCUMENTS

| | | | |
|---|---|---|---|
| 2,799,570 | 7/1957 | Reed | 75/0.5 BA |
| 3,341,322 | 9/1967 | Bailey | 75/0.5 AA |
| 3,424,572 | 1/1969 | Parikh | 75/0.5 BA |
| 3,702,270 | 11/1972 | Kawasaki et al. | 75/0.5 BA |
| 3,737,301 | 6/1973 | Chu | 75/0.5 BA |
| 4,063,000 | 12/1977 | Aonuma et al. | 252/62.55 |
| 4,067,755 | 1/1978 | Umeki et al. | 148/105 |
| 4,112,184 | 9/1978 | Umeki et al. | 428/403 |
| 4,167,582 | 9/1979 | Takahashi et al. | 252/62.55 |

*Primary Examiner*—L. Dewayne Rutledge
*Assistant Examiner*—John P. Sheehan
*Attorney, Agent, or Firm*—Lowe, King, Price & Becker

[57] ABSTRACT

A magnetic metallic powder comprising iron or iron-cobalt as its fundamental component and, besides, molybdenum in an amount of 0.05 to 5% by weight of the fundamental component. The magnetic powder is produced by heat reduction of a molybdenum-doped iron oxide powder which may optionally contain cobalt. The presence of molybdenum suppresses agglomeration of the heated particles and produces an improvement on the coercive force of the metallic powder.

12 Claims, 4 Drawing Figures

MAGNETIC IRON POWDER CONTAINING MOLYBDENUM

This is a division of application Ser. No. 948,566, filed Oct. 4, 1978, abandoned.

BACKGROUND OF THE INVENTION

This invention relates to a magnetic metallic powder of the type obtained by reduction of an iron oxide powder, which may optionally contain cobalt, and a magnetic recording medium utilizing this magnetic metallic powder.

In the production of magnetic recording media such as magnetic tapes, selective use is made of magnetic powder materials having relatively large values for both residual magnetization and coercive force. Recently, higher recording density and lower noise have been increasingly required of magnetic tapes, wherefore there is an unbounded demand for magnetic powder materials of extremely fine particle size and superior magnetic properties.

In such circumstances, it has been endeavored to obtain a ferromagnetic iron (essentially) powder which is satisfactorily large in magnetization per unit mass and especially high in coercive force by reduction (predominantly by heating in a reducing atmosphere typified by a hydrogen gas atmosphere) of an iron oxide powder such as maghemite ($\gamma$-$Fe_2O_3$), magnetite ($Fe_3O_4$), goethite (FeOOH) cobalt-containing maghemite, cobalt-containing magnetite or cobalt-containing goethite.

To realize required levels of high recording density and low noise when used in magnetic tapes, a magnetic iron powder (or iron-cobalt powder) must be very fine in particle size and anisotropic in particle shape besides a large magnetization value per unit mass and a high coercive force. In the case of producing a magnetic iron powder by reduction of an iron oxide power, it is a requisite that the iron oxide powder, too, is very finely divided and has shape anisotropy since not only the particle shape and size but also magnetization and coercive force of the obtained iron powder depend on the shape and size of the iron oxide particles.

Regarding the production of a ferromagnetic iron powder by heat reduction of a finely divided iron oxide powder, a problem awaiting solution is that the iron oxide particles tend to undergo sintering, i.e. agglomeration of the particles, during the reduction process particularly when the iron oxide particles are smaller than about 0.5 $\mu$m in their major axis length. This phenomenon makes it difficult to obtain a magnetic iron powder as very finely divided particles of an expected shape and accordingly with desired magnetic properties.

In the present application a magnetic powder produced by reduction of an iron oxide powder or iron-cobalt oxide powder will be called "metallic powder" because, as is commonly recognized, the product usually contains a certain amount of oxygen depending on the extent of the reduction.

SUMMARY OF THE INVENTION

It is an object of the present invention to provide a magnetic metallic powder fundamentally of iron or iron-cobalt particularly suitable for use in magnetic recording media such as magnetic tapes, which metallic powder has improved magnetic properties, particularly a high coercive force, and can readily be produced in the form of very finely divided particles of a desired shape.

It is another object of the invention to provide an improved magnetic recording medium which comprises a magnetic metallic powder according to the invention and serves for high density recording purposes.

A magnetic metallic powder according to the invention is fundamentally of iron or iron-cobalt and, as a novel feature, comprises molybdenum in an amount of 0.05% to 5% by weight of the iron or iron-cobalt.

A magnetic metallic powder according to the invention is produced by reduction of an iron oxide powder, which may optionally contain cobalt, in the presence of molybdenum or its ions.

More particularly and preferably, a finely divided powder of magnetite, maghemite or goethite, which may optionally contain Co in an amount up to about 20% by weight of Fe in the oxide, is first treated with an alkaline solution of a molybdenum compound such as molybdenum trioxide or molybdenum hydroxide, followed by washing and air drying, and then heated in a hydrogen gas stream at a temperature between about 250° C. and about 480° C. A magnetic metallic powder of acicular particles about 0.5 $\mu$m or shorter in major axis length can readily be produced by this process.

The introduction of molybdenum to an iron oxide powder to be reduced suppresses sintering or agglomeration of the particles during heating for reduction, and the obtained Mo-containing iron powder has a higher coercive force and scarcely exhibits a decrease in saturation magnetization compared with a corresponding iron powder produced without the introduction of molybdenum. The effect of the addition of molybdenum is maximized when Mo in the metallic powder amounts to from about 0.5% to about 3% by weight of Fe (Fe+Co in the case of containing Co, too) of the metallic powder. As an additional advantage of a magnetic metallic powder according to the invention, the powder exhibits less lowering of its coercive force when subjected to usual procedures for the production of magnetic tapes.

DESCRIPTION OF THE PREFERRED EMBODIMENTS

EXAMPLE 1

Figure 1:
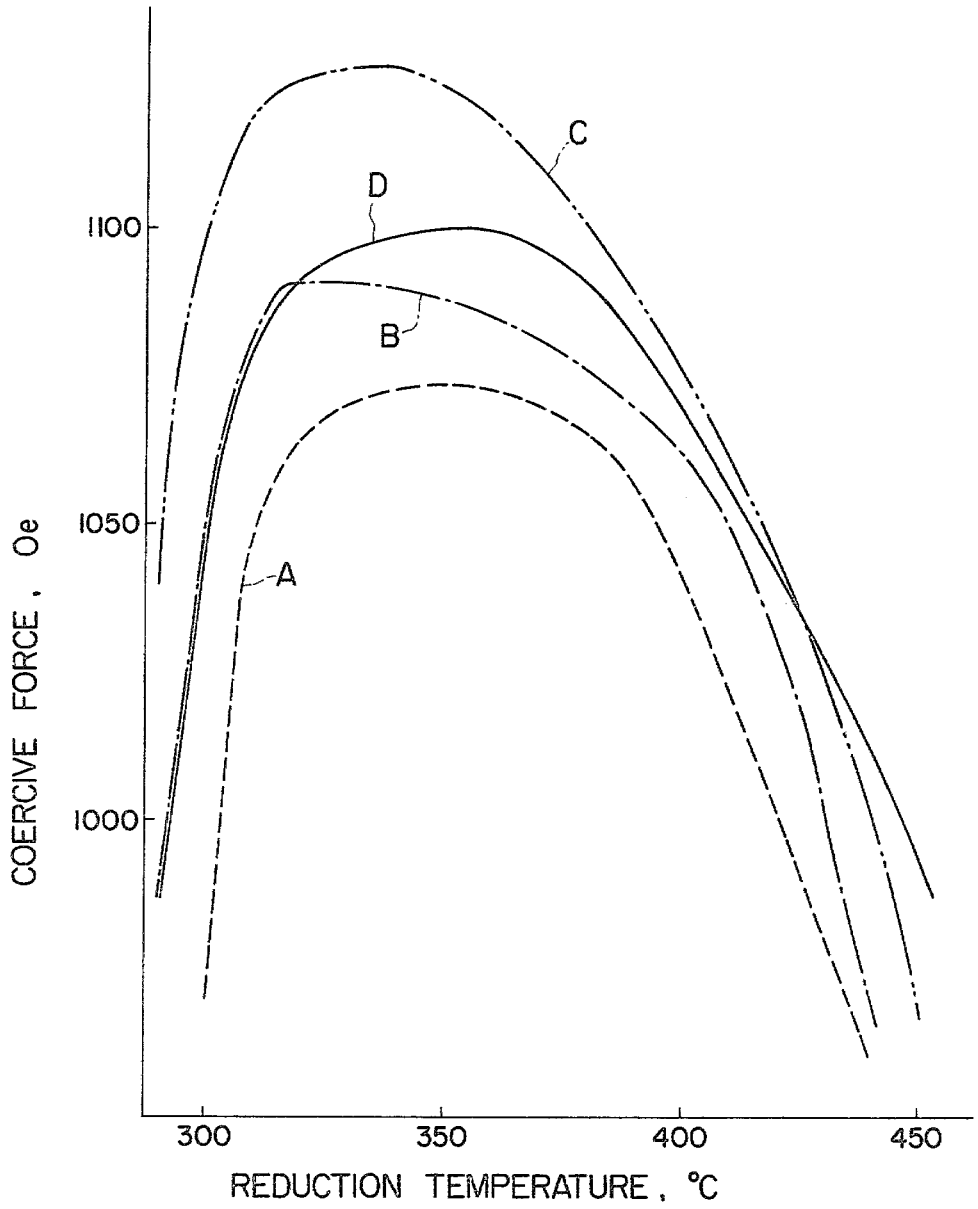
FIGS. 1 and 3 are graphs showing dependence of the coercive force of a magnetic metallic powder according to the invention on the amount of the introduced molybdenum and reduction temperature during production.

An alkaline solution of molybdenum trioxide $MoO_3$ was prepared by first dissolving 120 mg of $MoO_3$ in 500 ml of $\frac{1}{2}$ N solution of sodium hydroxide with stirring and then adding 300 ml of water to this solution with sufficient stirring.

Use was made of an acicular magnetite ($Fe_3O_4$) powder having a major axis length of about 0.5 $\mu$m (mean value) and an axis ratio of about 1:8 as the starting material for a magnetic iron powder. 10 g of the magnetite powder was put into the molybdenum trioxide solution and well dispersed in the solution by enough stirring at room temperature. Thereafter the dispersion was kept standing to allow settling of the magnetite particles which had absorbed molybdenum ions. Then the magnetite powder was separated from the solution by filtration, repeatedly washed with water and finally dried at a temperature of about 40° C.

Heating of the thus treated magnetite powder in a hydrogen gas stream (flow rate was 500 ml/min) for 6 hr at a temperature of 380° C. gave a metallic powder essentially of iron and containing Mo amounting to 0.8 Wt% of Fe. The metallic powder was obtained in the form of finely divided acicular particles having a major axis length of about 0.4 μm and an axis ratio of about 1:8.

For comparison, the magnetite powder was subjected to the same heat reduction process without carrying out the above described treatment with the molybdenum trioxide solution. The resulting iron powder was similar to the Mo-containing metallic powder in particle shape and size, but there occurred some extent of agglomeration of the particles during heating.

The coercive force of the Mo-containing metallic powder produced in this example was 1030 Oe (82.1 KA/m) while the coercive force of the reference metallic powder (not containing Mo) was 980 Oe (78.1 KA/m).

EXAMPLE 2

In this example, a Co-containing magnetic powder was used as the starting material. The Co content in this material was 2% by weight of Fe of the magnetite. This powder material was acicular in particle shape with a major axis length of about 0.4 μm (mean value) and an axis ratio of about 1:7.

Four alkaline solutions of molybdenum trioxide different in concentration were prepared each by the process in Example 1, i.e. by first dissolving a certain (selected) quantity of $MoO_3$ in 500 ml of ½ N solution of NaOH and thereafter adding 300 ml of water. The quantities of $MoO_3$ dissolved in the four solutions were as follows.

Solution A: 12 mg
Solution B: 36 mg
Solution C: 120 mg
Solution D: 1200 mg

In each of the $MoO_3$ solutions A, B, C and D, 10 g of the Co-containing magnetite powder was treated in accordance with the treatment in Example 1, whereby four kinds of Mo-doped powder materials were obtained. Each of these four kinds of powder materials were subjected to the heat reduction process as described in Example 1 except that the heating temperature was varied within the range from 290° C. to 470° C. for each material.

Irrespective of the molybdenum ion concentrations in the solutions A, B, C and D, the metallic powders produced in this example had an acicular particle shape with a major axis length of about 0.3 μm (mean value) and an axis ratio of about 1:7. These metallic powders contained the following amounts of Mo (percentages to the total of Fe and Co in each metallic powder).

Products through treatment with Solution A: 0.09 Wt%
Products through treatment with Solution B: 0.26 Wt%
Products through treatment with Solution C: 0.81 Wt%
Products through treatment with Solution D: 4.7 Wt%

Figure 2:
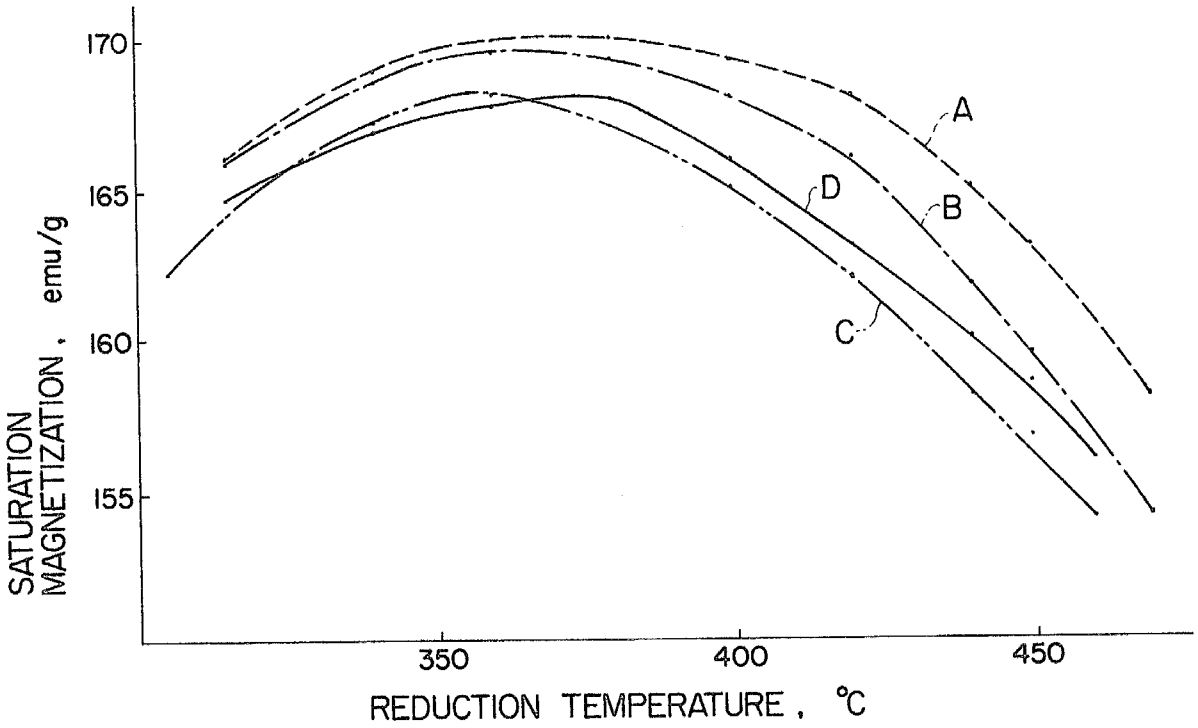
FIG. 2 is a graph showing dependence of the saturation magnetization of the same magnetic metallic powder on the amount of the introduced molybdenum and reduction temperature during production.
Figure 3:
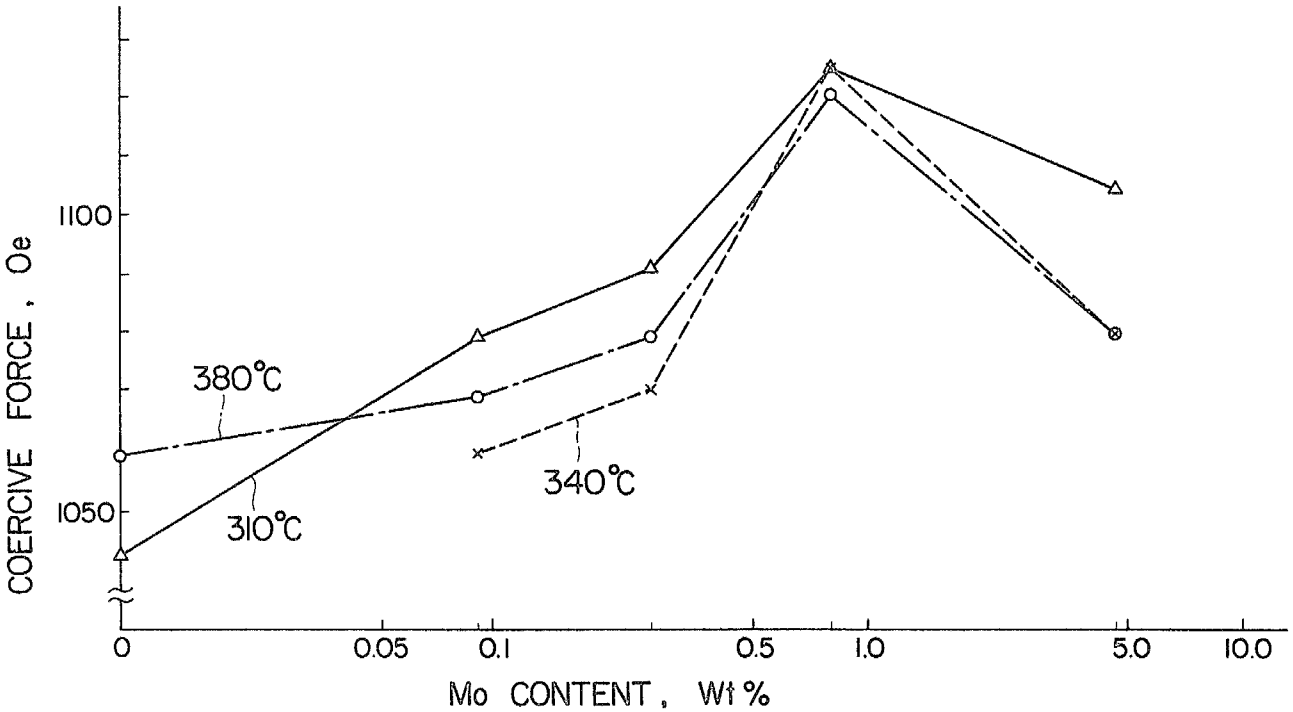
Figure 4:
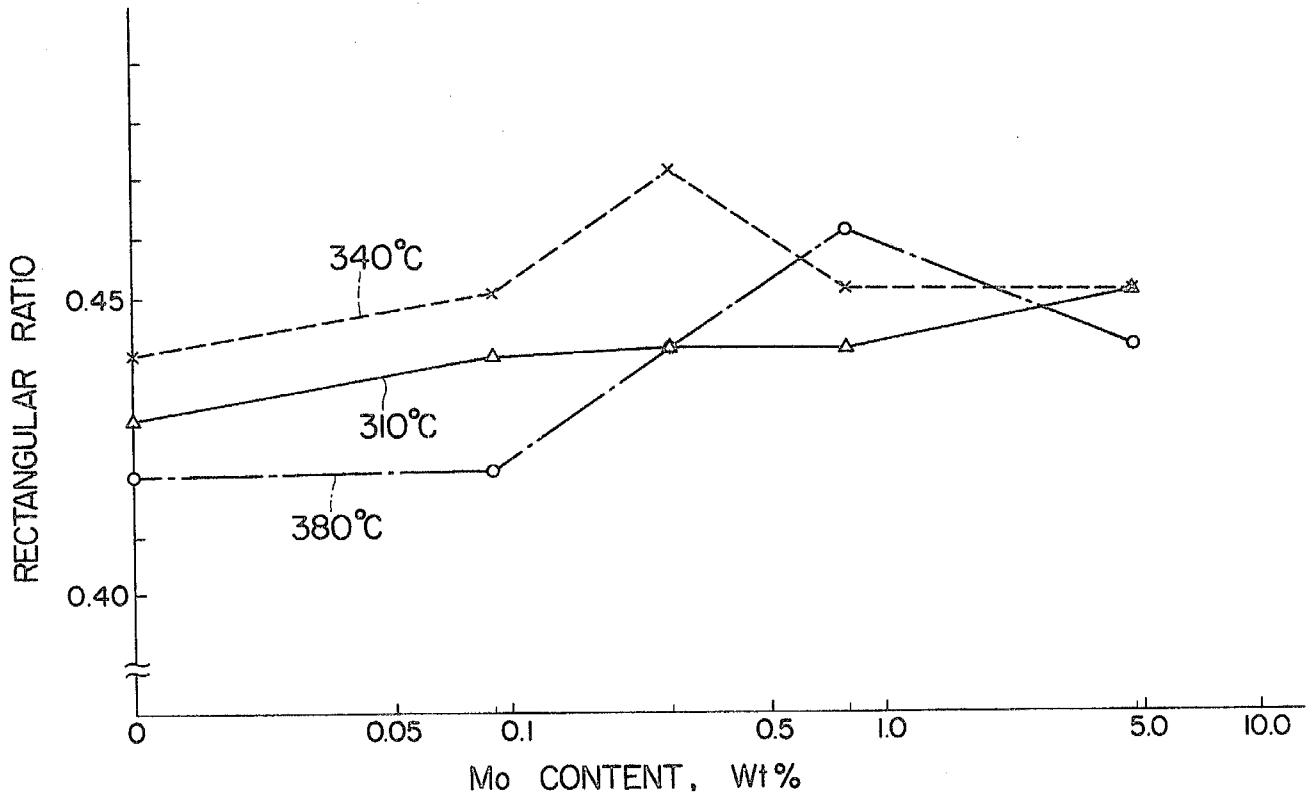
FIG. 4 is a graph showing dependence of the rectangular ratio of the same magnetic metallic powder on the amount of the introduced molybdenum and reduction temperature during production.

FIG. 1 shows variations in the coercive force of the magnetic metallic powders produced in this example, and FIG. 2 shows variations in the saturation magnetization of the same powders. The curves A, B, C and D in FIGS. 1 and 2 represent the metallic powders produced through treatment with the molybdenum trioxide solutions A, B, C and D, respectively. FIG. 3 presents the data of FIG. 1 in a different manner with the addition of coercive force values of iron-cobalt powders produced by heat reduction of the Co-containing magnetite powder used in Example 2 without the introduction of molybdenum into the powder. For the same samples, FIG. 4 shows the dependence of the rectangular ratio $R_s$ on the Mo-content in the metallic powders. The temperatures in FIGS. 3 and 4 represent the heating temperatures for the reduction of the Co-containing magnetite powders.

FIGS. 1–4 show that magnetic properties of a metallic powder according to the invention do not significantly vary when the reduction temperature for the production of the metallic powder is varied within the range between about 310° C. and about 380° C. This means that the production of a magnetic metallic powder according to the invention does not require a strict control of the reduction temperature and hence is easy to perform.

Based on a portion of the data of FIGS. 1–4 obtained at the reduction temperatures between 310° C. and 380° C., the following Table 1 presents mean values for coercive force $H_c$, saturation magnetization $\sigma_s$, residual magnetization $\sigma_r$ and rectangular ratio $R_s$ of two groups of metallic powders, one obtained by the reduction of the aforementioned Co-containing magnetite powder after the treatment with the $MoO_3$ solution C and the other obtained from the same starting material without the adsorption of molybdenum ions.

TABLE 1

| | Metallic powders not containing Mo | Metallic powders containing Mo (0.81%) |
|---|---|---|
| $H_c$ | 1080 Oe (86.1 KA/m) | 1120 Oe (89.3 KA/m) |
| $\sigma_s$ | 166 emu/g ($2.087 \times 10^{-4}$ Wb-m/kg) | 166 emu/g ($2.087 \times 10^{-4}$ Wb-m/kg) |
| $\sigma_r$ | 71 emu/g ($0.892 \times 10^{-4}$ Wb-m/kg) | 74 emu/g ($0.930 \times 10^{-4}$ Wb-m/kg) |
| $R_s$ | 0.43 | 0.45 |

As shown in Table 1, a magnetic metallic powder according to the invention has a remarkably high coercive force $H_c$ than a conventional magnetic metallic powder fundamentally analogous but not containing molybdenum. However, it is also shown that the presence of Mo, which is a nonmagnetic metal, in the magnetic metallic powder according to the invention scarcely causes a decrease in saturation magnetization $\sigma_s$. Besides, the presence of Mo produces an improvement on the rectangular ratio $R_s$ of the metallic powder.

Considering that the coercive force $H_c$ of a magnetic powder material depends greatly on shape anisotropy of the particles of the powder material and that the rectangular ratio $R_s$, too, depends on particle shape of the powder, it is believed to be the reason for an augmented coercive force $H_c$ and an improved rectangular ratio $R_s$ of a magnetic powder according to the invention that sintering of fine particles (and resulting changes in the shape and size distribution) of the particles during pyrolytic reduction of a magnetic iron (or iron-cobalt) oxide powder is effectively suppressed by molybdenum ions adsorbed by the oxide powder in advance of the reduction process.

EXAMPLE 3

This example illustrates the production of a magnetic tape using a magnetic powder according to the invention.

A magnetic paint was prepared from the following materials.

Magnetic powder: 100 parts by weight

This was a metallic powder produced in Example 2, containing 2% of Co and 0.81% of Mo.

Binder: 20 parts by weight

A mixture of (a) polyvinyl chloride comprising polyvinyl alcohol, (b) vinyl chloride-vinyl acetate copolymer and (c) polyurethane elastomer.

Solvent: 250 parts by weight

A mixture of (a) methylethyl ketone, (b) methylisobutyl ketone and (c) toluene.

Dispersant: 1 part by weight

Soybean lecithin.

Lubricant: 2 parts by weight

A mixture of oleic acid and silicone oil

For comparison, another magnetic paint was prepared by using a conventional iron-cobalt powder (not containing Mo) produced from the Co-containing magnetite used in Example 2 in place of the Mo-containing magnetic powder in the above listed ingredients.

Each of these magnetic paints was applied in a magnetic field to a 16 μm thick polyester film so as to give a magnetic coating having a thickness of 3 μm after drying.

Table 2 presents numerical values for the coercive force $H_c$ and rectangular ratio $R_s$ of the magnetic powders used in this example and the magnetic tapes produced by the application of the above described magnetic paints.

TABLE 2

| | 0% Mo | | 0.81% | |
|---|---|---|---|---|
| | Powder | Tape | Powder | Tape |
| Hc | 1080 Oe (86.1 KA/m) | 890 Oe (70.9 KA/m) | 1120 Oe (89.3 KA/m) | 980 Oe (78.1 KA/m) |
| $R_s$ | 0.43 | 0.79 | 0.45 | 0.81 |

As demonstrated by the data in Table 2, when a magnetic powder according to the invention is processed in the usual manner to produce a magnetic tape, the degree of an inevitable lowering in coercive force $H_c$ is considerably smaller than that in the case of similarly processing an analogous and conventional (not containing Mo) magnetic powder.

As illustrated by the foregoing examples, the present invention makes it possible to obtain a very finely divided magnetic powder having remarkably improved properties from a conventional iron (or iron-cobalt) oxide powder and can be easily put into industrial practice.

What is claimed is:

1. A method of producing a magnetic metallic powder useful in magnetic recording media having superior magnetic properties and characterized in having an improved coercive force and improved saturation magnetization, said metallic powder comprising iron as a principal component, the method comprising the steps of:

(a) treating a fine powder of an iron oxide which is acicular in particle shape with an alkaline aqueous solution of a molybdenum compound whereby said fine powder adsorbs molybdenum in the form of ions;

(b) drying the treated powder; and (c) heating the dried powder in a stream of a reducing gas at a temperature in the range from about 250° C. to about 480° C. to accomplish reduction of said iron oxide;

wherein step (a) is performed such that said magnetic metallic powder comprises molybdenum in an amount of 0.05 to 5% by weight of iron in said magnetic metallic powder.

2. A method according to claim 1, wherein said temperature is in the range from about 310° C. to about 380° C.

3. A method according to claim 1, wherein said molybdenum compound is molybdenum trioxide.

4. A method according to claim 1, wherein said molybdenum compound is molybdenum hydroxide, 5. A method according to claim 1, wherein said amount of molybdenum is from about 0.5 to about 3.0% by weight of iron in said magnetic metallic powder.

6. A method according to claim 1, wherein said iron oxide is selected from the group consisting of maghemite, magnetite and goethite.

7. A method of producing a magnetic metallic powder useful in magnetic recording media having superior magnetic properties and characterized in having an improved coercive force and improved saturation magnetization, said metallic powder comprising a major amount of iron and a minor amount of cobalt as principal components, the method comprising the steps of:

(a) treating a fine powder of a cobalt-containing iron oxide which is acicular in particle shape with an alkaline aqueous solution of a molybdenum compound whereby said fine powder adsorbs molybdenum in the form of ions;

(b) drying the treated powder; and (c) heating the dried powder in a stream of a reducing gas at a temperature in the range from about 250° C. to about 480° C. to accomplish reduction of said cobalt-containing iron oxide;

wherein step (a) is performed such that said magnetic metallic powder comprises molybdenum in an amount of 0.05 to 5% by weight of the total of iron and cobalt in said magnetic metallic powder.

8. A method according to claim 7, wherein said temperature is in the range from about 310° C. to about 380° C.

9. A method according to claim 7, wherein said molybdenum compound is molybdenum trioxide.

10. A method according to claim 7, wherein said molybdenum compound is molybdenum hydroxide.

11. A method according to claim 7, wherein said amount of molybdenum is from about 0.5 to about 3.0% by weight of iron in said magnetic metallic powder.

12. A method according to claim 7, wherein said cobalt-containing iron oxide is selected from the group consisting of cobalt-containing maghemite, cobalt-containing magnetite and cobalt-containing goethite.

* * * * *